US006962646B2

(12) United States Patent
Schwaner et al.

(10) Patent No.: US 6,962,646 B2
(45) Date of Patent: Nov. 8, 2005

(54) MULTI-LAYER HEADBOX

(75) Inventors: Mathias Schwaner, Ravensburg (DE); Jürgen Proessl, Horgenzell (DE)

(73) Assignee: Voith Paper Patent GmbH, Heidenheim (DE)

( * ) Notice: Subject to any disclaimer, the term of this patent is extended or adjusted under 35 U.S.C. 154(b) by 108 days.

(21) Appl. No.: 10/396,839

(22) Filed: Mar. 26, 2003

(65) Prior Publication Data

US 2003/0183352 A1 Oct. 2, 2003

(30) Foreign Application Priority Data

Mar. 27, 2002 (DE) ..... 102 13 853

(51) Int. Cl.[7] ..... D21F 1/00

(52) U.S. Cl. ..... 162/123; 162/216; 162/336; 162/343

(58) Field of Search ..... 162/123, 336, 162/343, 216

(56) References Cited

U.S. PATENT DOCUMENTS 4,225,386 A * 9/1980 Edblom et al. ..... 162/343
4,376,012 A 3/1983 Bergstrom
4,376,014 A * 3/1983 Bergstrom ..... 162/336
4,445,974 A * 5/1984 Stenberg ..... 162/300
4,543,162 A * 9/1985 Hildebrand ..... 162/343
5,431,785 A * 7/1995 Bubik et al. ..... 162/343
6,059,929 A * 5/2000 Dahl ..... 162/123

FOREIGN PATENT DOCUMENTS

| | | |
|---|---|---|
| DE | 2824608 | 1/1979 |
| DE | 3227218 | 1/1984 |
| EP | 0581051 | 2/1994 |
| GB | 1597809 | 9/1981 |
| GB | 2119824 | 11/1983 |

* cited by examiner

*Primary Examiner*—Peter Chin
(74) *Attorney, Agent, or Firm*—Greenblum & Bernstein, P.L.C.

(57) ABSTRACT

Multi-layer headbox for a paper machine that includes a plurality of nozzle chambers having outlet gaps located at nozzle chamber ends. Each of the plurality of nozzle chambers are assigned to different layers, and at least one of the plurality of nozzle chambers has a length in a flow direction that is different from a length of at least one other of the plurality of nozzle chambers. The instant abstract is neither intended to define the invention disclosed in this specification nor intended to limit the scope of the invention in any way.

23 Claims, 1 Drawing Sheet

MULTI-LAYER HEADBOX

CROSS-REFERENCE TO RELATED APPLICATIONS

The present application claims priority under 35 U.S.C. §119 of German Patent Application No. 10213853.2, filed on Mar. 27, 2002, the disclosure of which is expressly incorporated by reference herein in its entirety.

BACKGROUND OF THE INVENTION

1. Field of the Invention

The present invention relates to a multi-layer headbox for a paper machine with several nozzle chambers. Each nozzle chamber is assigned to one of the different layers and a partial suspension stream is assigned to each respective layer and guided to an outlet gap provided at the nozzle chamber end.

2. Discussion of Background Information

Such a multi-layer headbox is known, e.g., from European Patent No. EP 0 581 051 B1.

Multi-layer headboxes have hitherto been built with almost the same nozzle lengths per layer. Differences in length that result for structural reasons are clearly under 1% of the given nozzle length.

SUMMARY OF THE INVENTION

The present invention provides an improved multi-layer headbox of the type mentioned at the outset.

The invention includes nozzle chambers having, at least in part, different lengths measured in the flow direction.

Due to this embodiment, the technological advantages of the long nozzles are combined with those of the short nozzles in the multi-layer headbox. Naturally, the relevant differences in length of the nozzle chambers go beyond the differences in length resulting for structural reasons mentioned at the outset.

The maximum nozzle chamber length is preferably approx. 800 mm, since a clear improvement in jet stability results with increasing nozzle length up to approx. 800 mm.

The minimum nozzle chamber length is expediently less than or equal to 400 mm, in particular less than or equal to 350 mm and preferably approx. equal to 300 mm. Short nozzles generate higher turbulences than long nozzles. A clearly lower breaking length ratio and thus a higher lateral strength can be achieved with short nozzles.

A preferred expedient embodiment of the multi-layer headbox according to the invention is remarkable in that it is designed for at least three layers and in that the nozzle chambers assigned to the two outer layers have a greater length than at least one nozzle chamber assigned to a middle layer. The nozzle chambers assigned to the two outer layers can thereby have in particular the same length.

Such a headbox designed for at least three layers can advantageously be used in particular in combination with a gap former.

The difference in length between nozzle chambers of different lengths can advantageously be bridged by an intermediate chamber arranged between the respectively shorter nozzle chamber and the relevant flow spreader viewed in the flow direction. The intermediate chamber can be arranged in particular between two turbulence producer sections viewed in the flow direction.

However, in principle an embodiment is also conceivable in which the flow spreaders assigned to the different layers are staggered in the flow direction according to a respective difference in length between nozzle chambers of different lengths.

Thus, for instance, a three-layer headbox on a gap former or the like is conceivable which is provided, e.g., with two long nozzles for the outer layers and one short nozzle for the middle layer. The middle layer produced to be more turbulent keeps the entire length/width ratio low and ensures a high lateral strength. As a result of producing the outer layers with long nozzles, a good cover and an optimal formation are achieved.

According to another advantageous embodiment, the headbox is embodied as a two-layer headbox, whereby the nozzle chambers assigned to the two layers have different lengths measured in the flow direction. The longer nozzle chamber is thereby preferably assigned to a top layer and the shorter nozzle chamber to a back layer. The back is thus produced with a short nozzle and the top with a long nozzle. In this case the back is moved with a low length/width ratio and the top with an optimal jet for a good cover and formation.

The flow spreaders assigned to the two different layers can be staggered in the flow direction according to the difference in length between the two nozzle chambers of different lengths. However, the difference in length can, e.g., also again be bridged by an intermediate chamber arranged between the shorter nozzle chamber and the relevant flow spreader viewed in the flow direction. Such an intermediate chamber can be arranged in particular again between two turbulence producer sections viewed in the flow direction.

The present invention is directed to a multi-layer headbox for a paper machine that includes a plurality of nozzle chambers having outlet gaps located at nozzle chamber ends. Each of the plurality of nozzle chambers are assigned to different layers, and at least one of the plurality of nozzle chambers has a length in a flow direction that is different from a length of at least one other of the plurality of nozzle chambers.

According to a feature of the invention, each of the plurality of nozzles chambers can be arranged to receive at least a partial suspension flow.

A maximum nozzle chamber length can be approx. 800 mm. Further, a minimum nozzle chamber length can be less than or equal to 400 mm, preferably less than or equal to 350 mm, and most preferably approx. equal to 300 mm.

In accordance with another feature of the invention, the plurality of nozzle chambers can include at least three nozzle chambers arranged to form at least three layers. Further, two of the at least three nozzle chambers may be arranged to form outer layers and have a length greater than at least one nozzle chamber arranged to a form at least one middle layer. The nozzle chambers may be arranged to form the outer layers are a same length. A difference in length between a longer length nozzle chamber and a shorter length nozzle chamber may be bridged by an intermediate chamber arranged between the shorter nozzle chamber and a flow spreader viewed in the flow direction. Still further, the intermediate chamber can be arranged between two turbulence producer sections viewed in the flow direction.

The multi-layer headbox can also include flow spreaders assigned to each layer, which are staggered in a flow direction according to a difference in length between nozzle chambers of different lengths.

The plurality of nozzle chambers may include two nozzle chambers arranged to form a two-layer headbox and the two nozzle chambers can have different lengths measured in a flow direction. A longer of the two nozzle chambers may be arranged to form a top layer and a shorter of the two nozzle chambers is arranged to form a back layer. The multi-layer headbox may also include flow spreaders assigned to each layer, which are staggered in the flow direction according to a difference in length between the two nozzle chambers. Further, a difference in length between the two nozzle chambers can be bridged by an intermediate chamber arranged between, viewed in the flow direction, a shorter of the two nozzle chambers and the flow spreader assigned to the shorter nozzle chamber. The intermediate chamber may be positioned between two turbulence producer sections.

In accordance with still another feature of the instant invention, the nozzle chamber ends can be aligned with each other.

The present invention is directed to a process of forming a multi-layer web that includes guiding partial suspension streams through a plurality of nozzle chambers arranged to form the multi-layer web. At least one of the plurality of nozzle chambers has a different length in a flow direction than at least one other of the plurality of nozzle chambers.

According to a feature of present invention, the plurality of nozzle chambers can include at least three nozzle chambers, and partial suspensions forming outer layers may be guided through longer nozzle chambers than at least one partial suspension forming at least one middle layer. The process can also include guiding the at least one partial suspension forming the middle layer through two turbulence producing sections separated by an intermediate chamber.

According to another feature of the invention, the plurality of nozzle chambers can include at least three nozzle chambers, and the process can further include generating higher turbulences in the partial suspension forming at least one middle layer than in the partial suspensions forming outer layers.

In accordance with still yet another feature of the present invention, the plurality of nozzle chambers can include two nozzle chambers, and a partial suspension forming a top layer is guided through longer nozzle chamber than a partial suspension forming a back layer.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
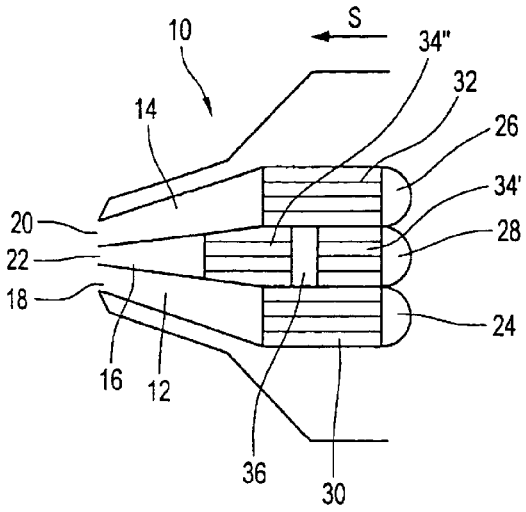
FIG. 1 diagrammatically illustrates a sectional view of a three-layer headbox with two longer nozzle chambers assigned to the two outer layers and one comparatively shorter nozzle chamber for the middle layer, such that the difference in length between the nozzle chambers of different lengths is bridged by an intermediate chamber.

FIG. 1 shows in diagrammatic sectional representation a three-layer headbox 10 with two longer nozzle chambers 12 and 14 assigned to the two outer layers and a comparatively clearly shorter nozzle chamber 16 for the middle layer. As can be seen from FIG. 1, in the present case the middle nozzle chamber 16 is approx. ⅓ shorter than the two outer nozzle chambers 12 and 14.

In the nozzle chambers 12, 14, and 16 the relevant partial suspension streams are respectively guided to an outlet gap 18, 20, and 22 provided at the nozzle chamber end.

A turbulence producer 30, 32, and 34 can be provided respectively between the nozzle chambers 12, 14, and 16 and the flow spreaders assigned to the respective layer.

In the present case, the difference in length between the nozzle chambers 12, 14, and 16 of different lengths is bridged by an intermediate chamber 36 that is arranged viewed in the flow direction S between the flow spreader 28 for the middle layer and the nozzle chamber 16 assigned to it.

The maximum nozzle chamber length can be, e.g., approx. 800 mm. The minimum nozzle chamber length is, e.g., less than or equal to 400 mm, in particular less than or equal to 350 mm and preferably approx. equal to 300 mm.

In the present case, the intermediate chamber 36 is arranged between two turbulence producer sections 34' and 34".

Such a multi-layer headbox 10 can be used in particular in combination with a gap former.

Figure 2:
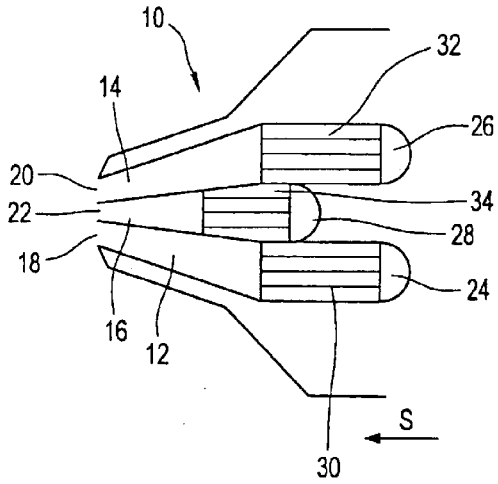
FIG. 2 diagrammatically illustrates a sectional view of a comparable three-layer headbox without an intermediate chamber.

FIG. 2 shows in diagrammatic sectional representation a three-layer headbox 10 comparable to that of FIG. 1 with two longer nozzle chambers 12, 14 assigned to the two outer layers and one comparatively clearly shorter nozzle chamber 16 for the middle layer. This three-layer headbox 10 differs from that of FIG. 1 only in that here there is no intermediate chamber and instead the flow spreaders 24, 26, and 28 assigned to the different layers are staggered in the flow directions according to the difference in length between the shorter middle nozzle chamber 16 on the one hand and the two longer nozzle chambers 12 and 14 on the other hand. In FIG. 2 the middle flow spreader is thus displaced to the left with respect to the two outer flow spreaders 24 and 26, i.e., towards the outlet gaps 18, 20, and 22. Thus in the present case only a single turbulence producer 34 is provided between the flow spreader 28 and the nozzle chamber 16.

Otherwise this three-layer headbox 10 at least essentially again has the same structure as that of FIG. 1. Corresponding parts have been assigned the same reference numbers.

With the three-layer headboxes described above the middle layer produced to be more turbulent keeps the entire length/width ratio low and ensures a high lateral strength. By producing the outer layers by long nozzles, a good cover and an optimal formation are obtained.

A two-layer headbox, for instance, can also be embodied in a similar manner.

Figure 3:
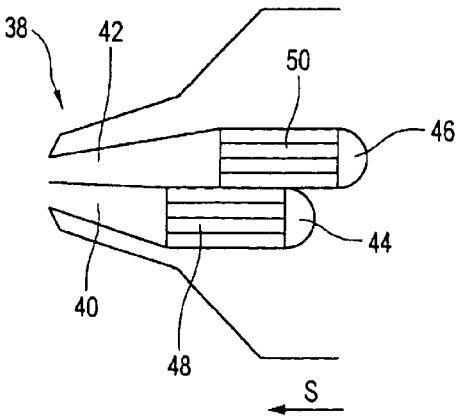
FIG. 3 diagrammatically illustrates a sectional view of a two-layer headbox, the nozzle chambers of which assigned to the two layers have different lengths.

FIG. 3 shows in diagrammatic sectional representation such a two-layer headbox 38 with which the nozzle chambers 40 and 42 assigned to the two layers have different lengths measured in the flow direction S. The back is produced with the nozzle featuring the shorter nozzle chamber 40 and the top with the nozzle featuring the longer nozzle chamber 42.

In the present case the back is thus produced with a relatively low length/width ratio, whereas the top is moved with an optimal jet for a good cover and formation.

A turbulence producer 48 or 50, for example, can again be provided respectively in the flow direction S between the flow chambers 40 and 42 and the assigned flow spreaders 44 and 46.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| List of Reference Numbers | |
|---|---|
| 10 | Three-layer headbox |
| 12 | Longer nozzle chamber |
| 14 | Longer nozzle chamber |
| 16 | Shorter nozzle chamber |
| 18 | Outlet gap |
| 20 | Outlet gap |
| 22 | Outlet gap |
| 24 | Flow spreader |
| 26 | Flow spreader |
| 28 | Flow spreader |
| 30 | Turbulence producer |
| 32 | Turbulence producer |
| 34 | Turbulence producer |
| 34 | Turbulence producer section |
| 34 | Turbulence producer section |
| 36 | Intermediate chamber |
| 38 | Two-layer headbox |
| 40 | Shorter nozzle chamber |
| 42 | Longer nozzle chamber |
| 44 | Flow spreader |
| 46 | Flow spreader |
| 48 | Turbulence producer |
| 50 | Turbulence producer |
| S | Flow direction |

What is claimed:

1. A multi-layer headbox for a paper machine comprising:

a plurality of nozzle chambers having separate outlet gaps located at nozzle chamber ends at substantially the same position in a flow direction in which each nozzle chamber is associated with one of a plurality of layers;

a plurality of flow spreaders each associated with one of said plurality of nozzle chambers; and at least one of said plurality of nozzle chambers having a length in the flow direction that is different from a length of at least one other of said plurality of nozzle chambers and at least two of the plurality of flow spreaders being positionally staggered in the flow direction relative to each other.

2. The multi-layer headbox in accordance with claim 1, wherein each of said plurality of nozzles chambers are arranged to receive at least a partial suspension flow.

3. The multi-layer headbox in accordance with claim 1, wherein a maximum nozzle chamber length is approx. 800 mm.

4. The multi-layer headbox in accordance with claim 1, wherein a minimum nozzle chamber length is less than or equal to 400 mm.

5. The multi-layer headbox in accordance with claim 4, wherein the minimum nozzle chamber length is less than or equal to 350 mm.

6. The multi-layer headbox in accordance with claim 4, wherein the minimum nozzle chamber length is approx. equal to 300 mm.

7. The multi-layer headbox in accordance with claim 1, wherein said plurality of nozzle chambers comprises at least three nozzle chambers arranged to form at least three layers, and wherein two of said at least three nozzle chambers are arranged to form outer layers and have a length greater than at least one nozzle chamber arranged to a form at least one middle layer.

8. The multi-layer headbox in accordance with claim 7, wherein said nozzle chambers arranged to form the outer layers are a same length.

9. The multi-layer headbox in accordance with claim 7, wherein a difference in length between a longer length nozzle chamber and a shorter length nozzle chamber is bridged by an intermediate chamber arranged between said shorter nozzle chamber and one of the plurality of flow spreaders spreaded viewed in the flow direction.

10. The multi-layer headbox in accordance with claim 9, wherein said intermediate chamber is arranged between two turbulence producer sections viewed in said flow direction.

11. The multi-layer headbox in accordance with claim 1, wherein each of the plurality of flow spreaders associated with each layer are staggered in a flow direction according to a difference in length between nozzle chambers of different lengths.

12. The multi-layer headbox in accordance with claim 1, wherein said plurality of nozzle chambers comprises two nozzle chambers arranged to form a two-layer headbox and said two nozzle chambers have different lengths measured in a flow direction.

13. The multi-layer headbox in accordance with claim 12, wherein a longer of said two nozzle chambers is arranged to form a top layer and a shorter of said two nozzle chambers is arranged to form a back layer.

14. The multi-layer headbox in accordance with claim 12, wherein each of the plurality of flow spreaders associated with each layer are staggered in said flow direction according to a difference in length between said two nozzle chambers.

15. The multi-layer headbox in accordance with claim 12, wherein a difference in length between said two nozzle chambers is bridged by an intermediate chamber arranged between, viewed in said flow direction, a shorter of said two nozzle chambers and said flow spreader assigned to said shorter nozzle chamber.

16. A multi-layer headbox for a paper machine comprising:

a plurality of nozzle chambers having outlet gaps located at nozzle chamber ends;

each of said plurality of nozzle chambers being associated with different layers and at least one of said plurality of nozzle chambers having a length in a flow direction that is different from a length of at least one other of said plurality of nozzle chambers, wherein said plurality of nozzle chambers comprise two nozzle chambers arranged to form a two-layer headbox and said two nozzle chambers have different lengths measured in a flow direction and a difference in length between said two nozzle chambers is bridged by an intermediate chamber arranged between, viewed in said flow direction, a shorter of said two nozzle chambers and said flow spreader associated with said shorter nozzle chamber and wherein said intermediate chamber is positioned between two turbulence producer sections.

17. The multi-layer headbox in accordance with claim 1, wherein said nozzle chamber ends are aligned with each other.

18. A process of forming a multi-layer web, comprising:

guiding partial suspension streams through a plurality of nozzle chambers and a plurality of flow spreaders arranged to form the multi-layer web, wherein the plurality of nozzle chambers have separate outlet gaps located at nozzle chamber ends at substantially the same position in a flow direction and at least one of said plurality of nozzle chambers has a different length in a flow direction than at least one other of the plurality of nozzle chambers, and at least two of the plurality of flow spreaders are positionally staggered in the flow direction relative to each other.

19. The process in accordance with claim 18, wherein the plurality of nozzle chambers includes at least three nozzle chambers, and wherein partial suspensions forming outer layers are guided through longer nozzle chambers than at least one partial suspension forming at least one middle layer.

20. The process in accordance with claim 19, further comprising guiding the at least one partial suspension forming the middle layer through two turbulence producing sections separated by an intermediate chamber.

21. The process in accordance with claim 18, wherein the plurality of nozzle chambers include at least three nozzle chambers, and the process further comprises:

generating higher turbulences in the partial suspension forming at least one middle layer than in the partial suspensions forming outer layers.

22. The process in accordance with claim 18, wherein the plurality of nozzle chambers includes two nozzle chambers, and wherein a partial suspension forming a top layer is guided through longer nozzle chamber than a partial suspension forming a back layer.

23. The multi-layer headbox in accordance with claim 15, wherein said intermediate chamber is positioned between two turbulence producer sections.

* * * * *